US011686044B2

(12) United States Patent
Matsuda et al.

(10) Patent No.: US 11,686,044 B2
(45) Date of Patent: Jun. 27, 2023

(54) FIBROUS BODY ACCUMULATING DEVICE AND ESTIMATION METHOD

(71) Applicant: SEIKO EPSON CORPORATION, Tokyo (JP)

(72) Inventors: Kensaku Matsuda, Nagano (JP); Naotaka Higuchi, Nagano (JP); Masahide Nakamura, Nagano (JP); Tomohide Onogi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 19 days.

(21) Appl. No.: 17/460,374

(22) Filed: Aug. 30, 2021

(65) Prior Publication Data

US 2022/0064856 A1 Mar. 3, 2022

(30) Foreign Application Priority Data

Aug. 31, 2020 (JP) ..... JP2020-146206

(51) Int. Cl.
*D21F 1/74* (2006.01)
*D21G 9/00* (2006.01)

(52) U.S. Cl.
CPC ..... *D21F 1/74* (2013.01); *D21G 9/0018* (2013.01); *D21G 9/0054* (2013.01)

(58) Field of Classification Search
CPC ..... D21F 1/74; D21G 9/0018; D21G 9/0054; B27N 3/146; B27N 1/00; B27N 3/04; B27N 3/08; B27N 3/18; B27L 11/08
See application file for complete search history.

(56) References Cited

U.S. PATENT DOCUMENTS

2016/0222585 A1* 8/2016 Menke ..... D21D 5/06

FOREIGN PATENT DOCUMENTS

| | | | | |
|---|---|---|---|---|
| CN | 209166558 U | * | 7/2019 | ..... G01F 1/86 |
| CN | 209166558 U | | 7/2019 | |
| DE | 10122966 A1 | * | 11/2002 | ..... B27N 3/146 |
| DE | 10122966 A1 | | 11/2002 | |
| JP | 2016-137608 A | | 8/2016 | |
| JP | 2021-050449 A | | 4/2021 | |
| JP | 2021-050450 A | | 4/2021 | |

* cited by examiner

*Primary Examiner* — Eric Hug
*Assistant Examiner* — Matthew M Eslami
(74) *Attorney, Agent, or Firm* — Global IP Counselors, LLP

(57) ABSTRACT

A fibrous body accumulating device includes an accumulating section including a drum that introduces and releases a material including fibers, a detection section detecting a presence of the material in the drum, and an estimation section estimating an amount of the material in the drum based on a detection frequency at which the detection section detects the material. The fibrous body accumulating device further includes a storage section in which a calibration curve showing a relationship between the detection frequency and the amount of the material in the drum is stored, and the estimation section calculates information on the detection frequency and estimates the amount of the material in the drum with reference to the calibration curve.

9 Claims, 8 Drawing Sheets

FIBROUS BODY ACCUMULATING DEVICE AND ESTIMATION METHOD

The present application is based on, and claims priority from JP Application Serial Number 2020-146206, filed Aug. 31, 2020, the disclosure of which is hereby incorporated by reference herein in its entirety.

BACKGROUND

1. Technical Field

The present disclosure relates to a fibrous body accumulating device and an estimation method.

2. Related Art

In the related art, a sheet manufacturing apparatus uses a so-called wet type in which a raw material containing fiber is put into water and then defibrated and repulped by primarily mechanical action. Such a wet type sheet manufacturing apparatus requires a large amount of water, which makes the apparatus larger. Further, it takes time to maintain water treatment facilities, and large energy is required for a drying process.

Therefore, in order to reduce a size of the sheet manufacturing apparatus and save energy, a dry sheet manufacturing apparatus without using water as possible has been proposed. For example, JP-A-2004-292959 discloses a device in which a raw material is defibrated by a dry method to accumulate and mold the defibrated material into a sheet shape. The device includes an accumulating section that accumulates the defibrated material, a housing, a cylindrical screen that is provided in the housing and formed of a porous body, and a rotating body that rotates inside the screen. The defibrated material supplied into the screen passes through the screen while being loosened in the screen by the rotation of the rotating body, is released and dispersed into the air, and is accumulated on a belt. As a result, a web is formed.

A release amount of the defibrated material varies depending on increase and decrease in amount of defibrated material in the cylindrical screen. In this case, the web does not have a desired thickness distribution, which may lead to deterioration of sheet quality. However, the device disclosed in JP-A-2004-292959 cannot detect the amount of defibrated material in the cylindrical screen. Therefore, the release amount of the defibrated material cannot be adjusted.

SUMMARY

The present disclosure can be realized in the following aspects.

According to an aspect of the present disclosure, a fibrous body accumulating device includes: an accumulating section including a drum that introduces and releases a material including fibers; a detection section detecting a presence of the material in the drum; and an estimation section estimating an amount of the material in the drum based on a detection frequency at which the detection section detects the material.

According to another aspect of the present disclosure, an estimation method for estimating an amount of a material including fibers in an accumulating section including a drum that introduces and releases the material, the estimation method includes detecting a presence of the material in the drum, and estimating the amount of the material in the drum based on a detection frequency.

DESCRIPTION OF EXEMPLARY EMBODIMENTS

Hereinafter, a fibrous body accumulating device and an estimation method of the present disclosure will be described in detail based on preferred embodiments shown in the accompanying drawings.

First Embodiment

Figure 1:
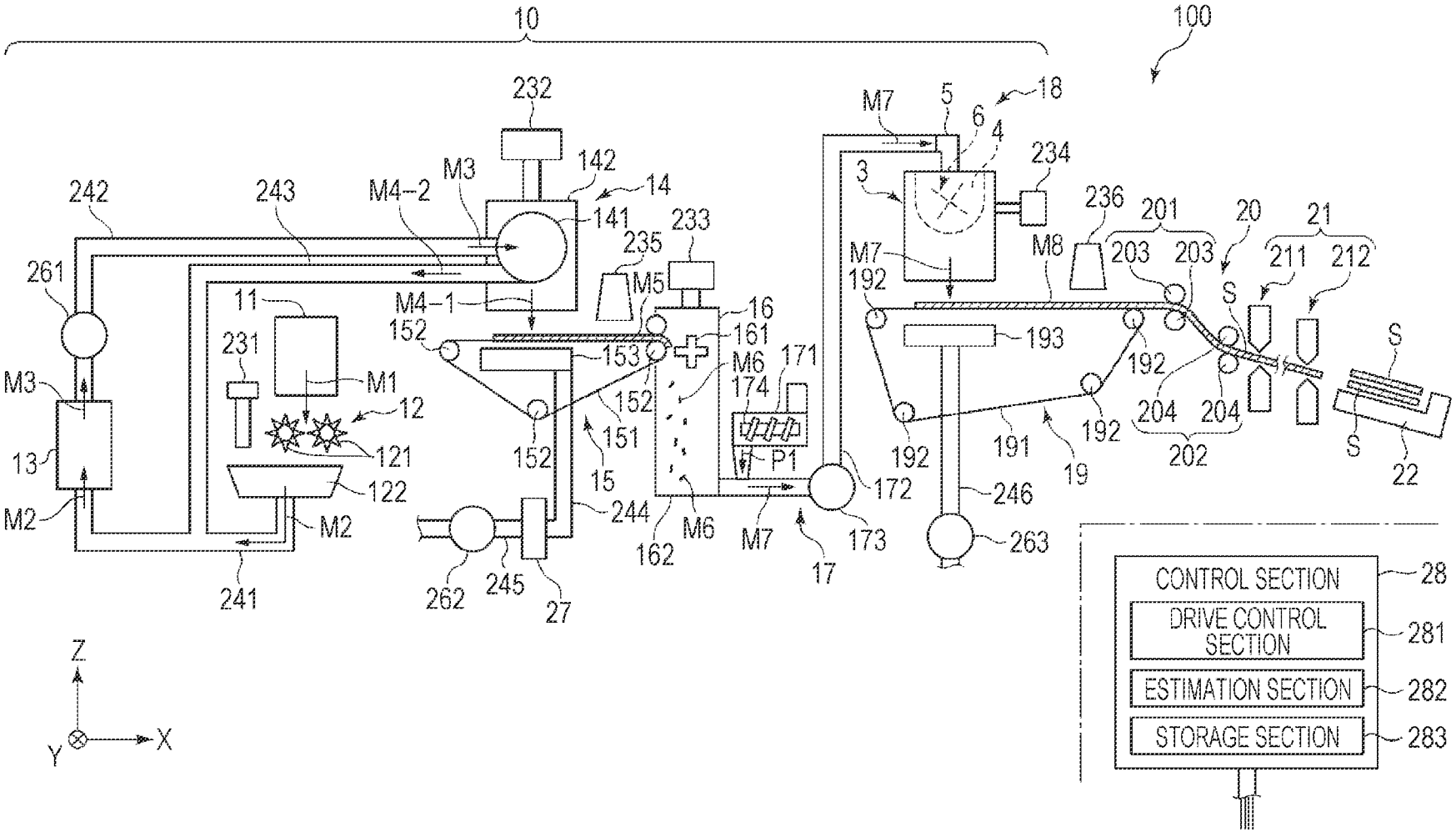
FIG. 1 is a side view schematically illustrating a first embodiment of a fibrous body accumulating device according to the present disclosure.
Figure 2:
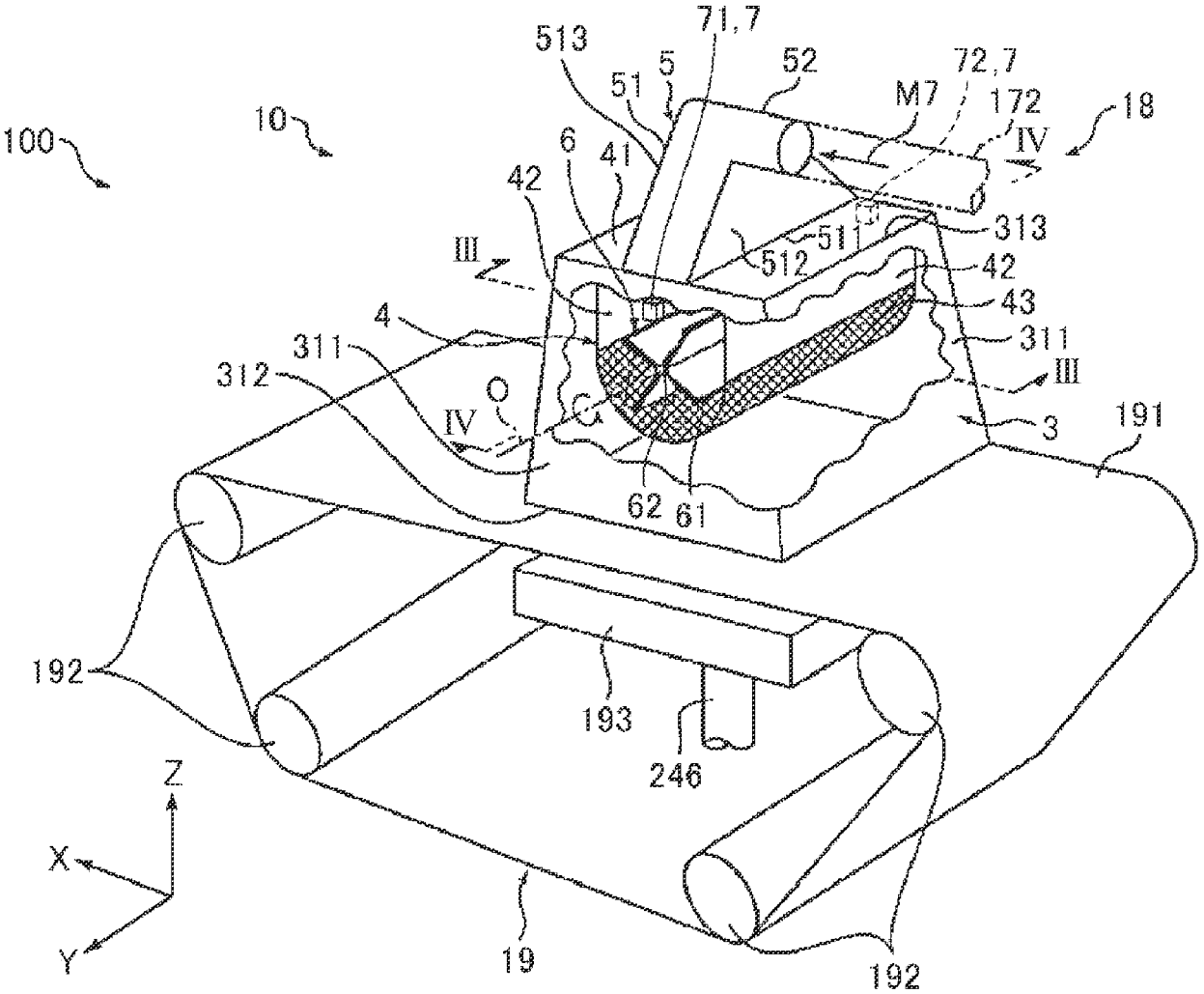
FIG. 2 is a perspective view illustrating a dispersion section and a second web forming section illustrated in FIG. 1.
Figure 3:
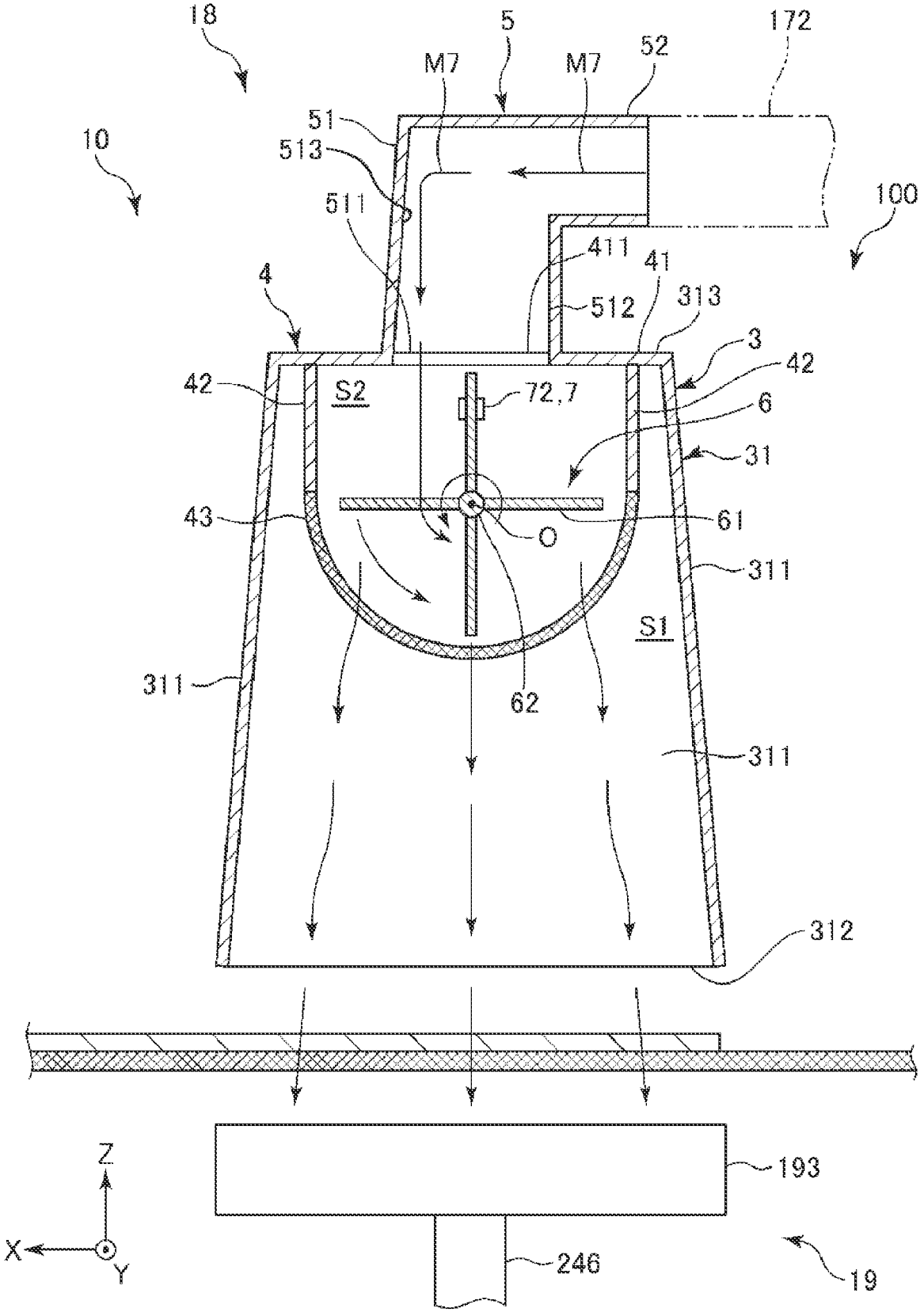
FIG. 3 is a cross-sectional view taken along line in FIG. 2.
Figure 4:
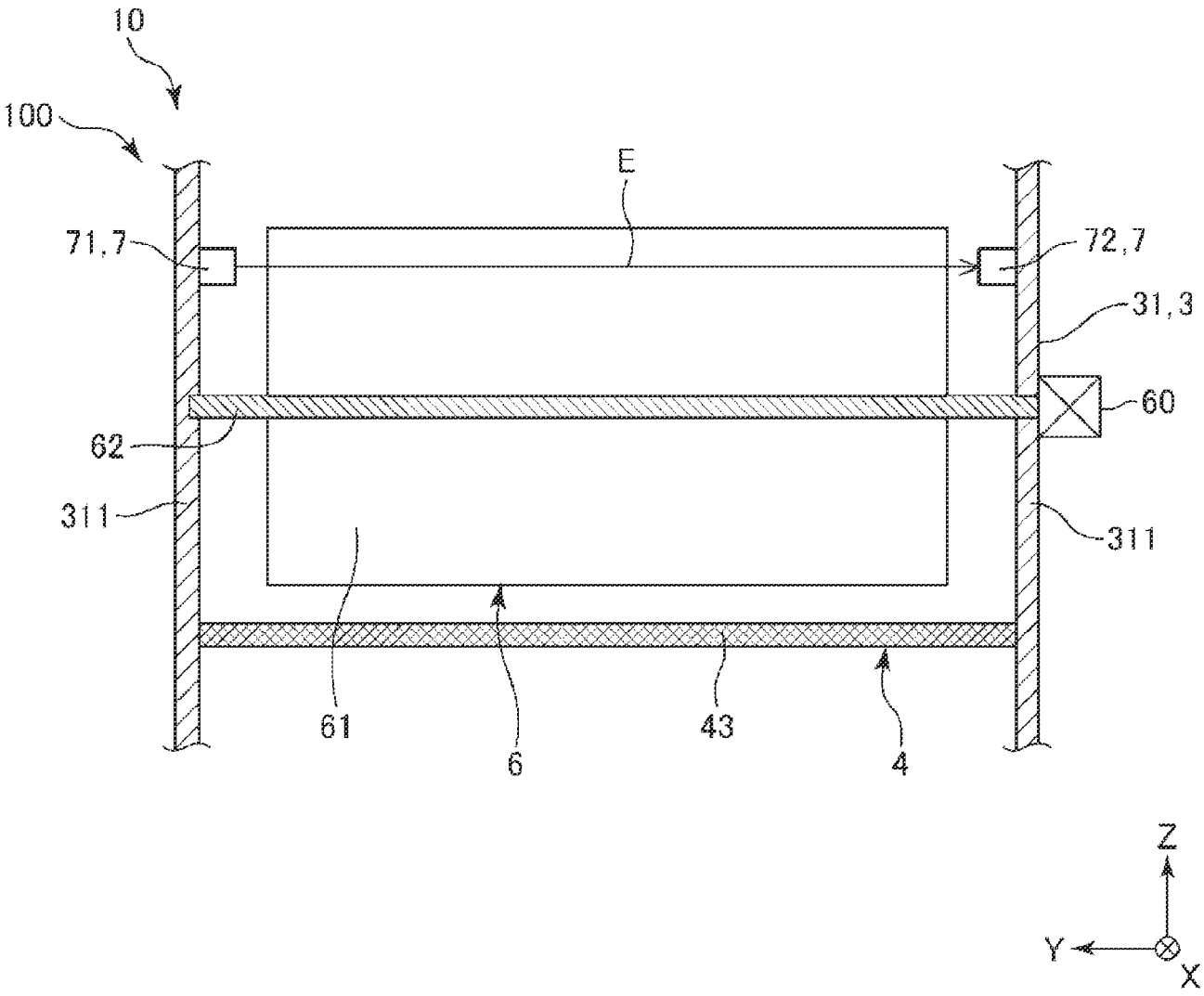
FIG. 4 is a cross-sectional view taken along line IV-IV in FIG. 2.
Figure 5:
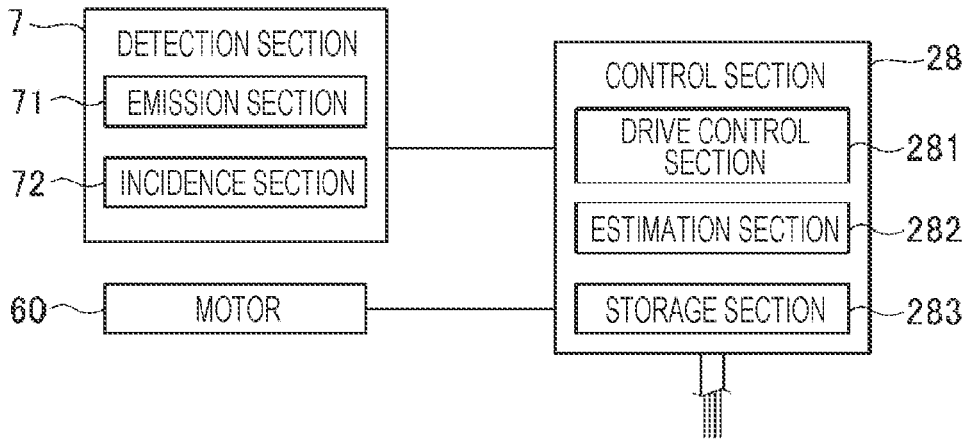
FIG. 5 is a block diagram of the fibrous body accumulating device illustrated in FIG. 1.
Figure 6:
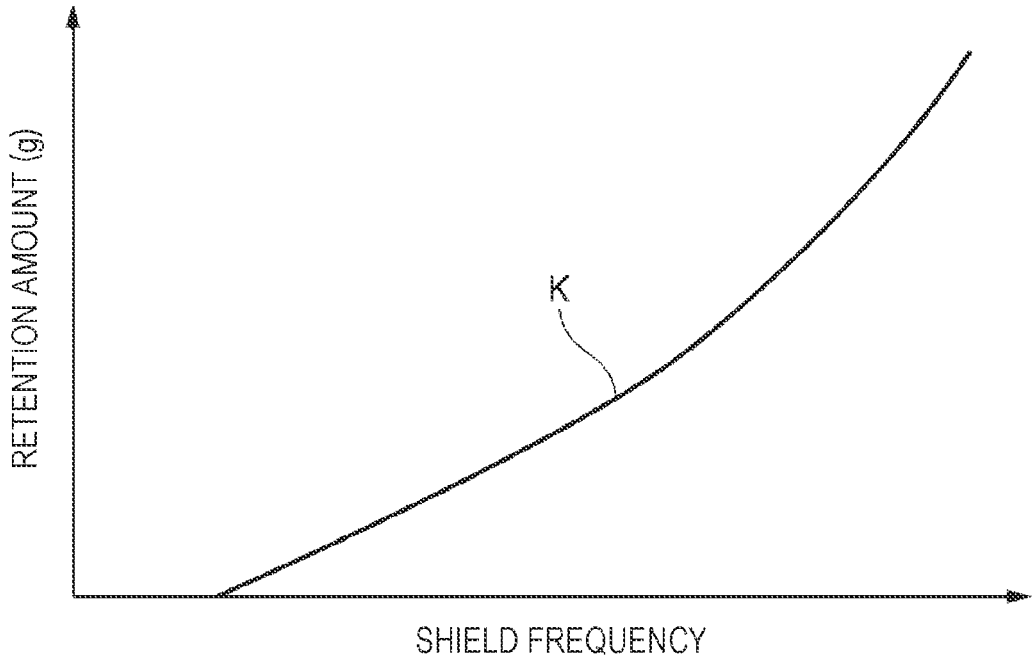
FIG. 6 is a graph for explaining a calibration curve stored in a storage section.
Figure 7:
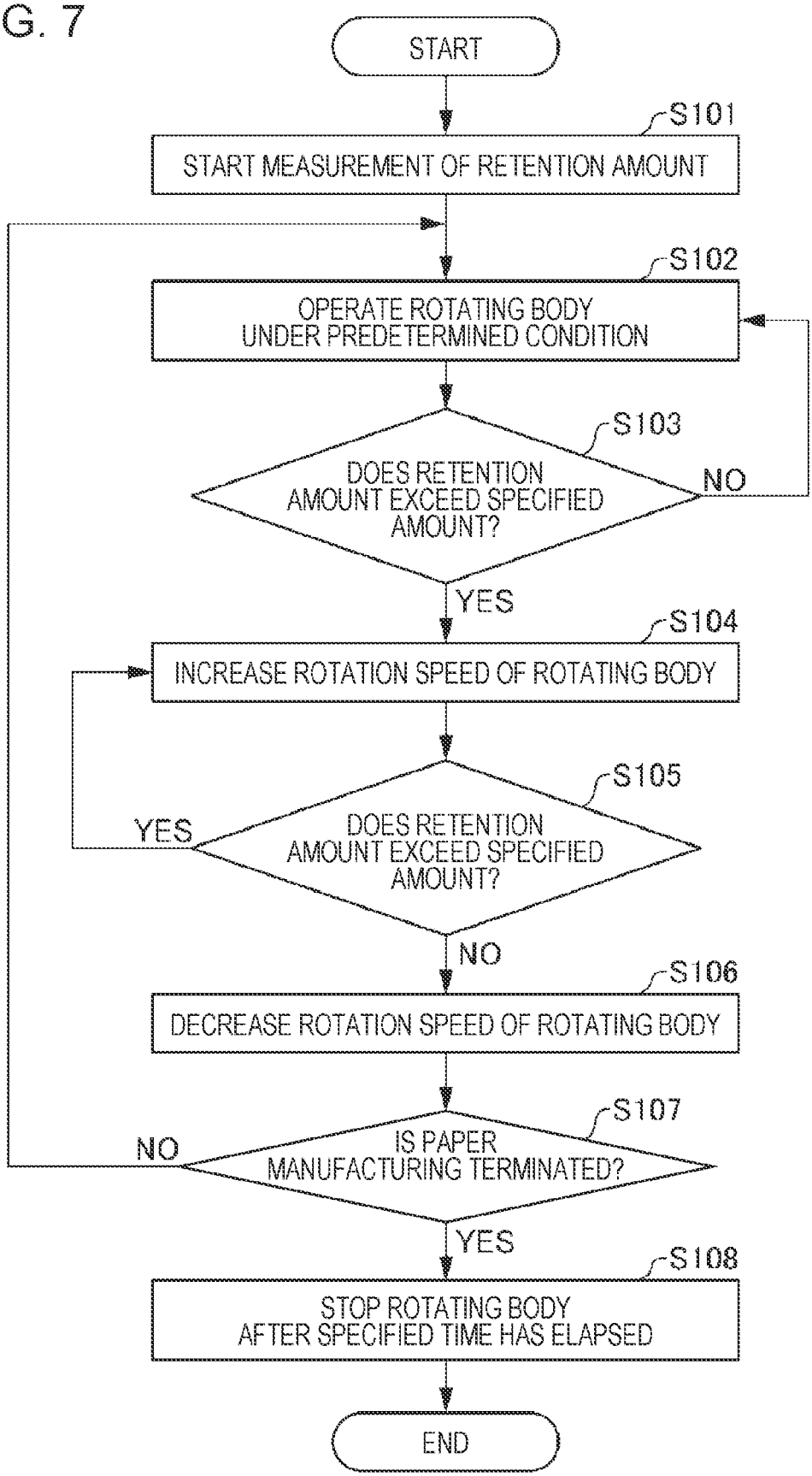
FIG. 7 is a flowchart for explaining an example of an estimation method executed by a control section illustrated in FIG. 1.

FIG. 1 is a side view schematically illustrating a first embodiment of a fibrous body accumulating device according to the present disclosure. FIG. 2 is a perspective view illustrating a dispersion section and a second web forming section illustrated in FIG. 1. FIG. 3 is a cross-sectional view taken along line in FIG. 2. FIG. 4 is a cross-sectional view taken along line IV-IV in FIG. 2. FIG. 5 is a block diagram of the fibrous body accumulating device illustrated in FIG. 1. FIG. 6 is a graph for explaining a calibration curve stored in a storage section. FIG. 7 is a flowchart for explaining an example of an estimation method executed by a control section illustrated in FIG. 1.

In the following, for convenience of explanation, as illustrated in FIGS. 1 to 4, three axes orthogonal to each other are referred to as an X axis, a Y axis, and a Z axis. The XY plane including the X axis and the Y axis is horizontal, and the Z axis is vertical. The direction in which the arrow of each axis points is called "+", and the opposite direction is called "−". Also, the upper side of FIG. 1 is referred to as "upper" or "above", and the lower side is referred to as "lower" or "below". Further, the left side in FIG. 1 is referred to as "upstream", and the right side is referred to as "downstream".

As illustrated in FIG. 1, a sheet manufacturing apparatus 100 includes a fibrous body accumulating device 10, a sheet molding section 20, a cutting section 21, a stock section 22, and a collection section 27. In addition, the fibrous body accumulating device 10 includes a raw material supply section 11, a crushing section 12, a defibrating section 13, a sorting section 14, a first web forming section 15, a subdividing section 16, a mixing section 17, an accumulating section 18, a second web forming section 19, and a control section 28.

Further, as illustrated in FIG. 1, the sheet manufacturing apparatus 100 includes a humidifying section 231, a humidifying section 232, a humidifying section 233, a humidifying section 234, a humidifying section 235, and a humidifying section 236. In addition, the sheet manufacturing apparatus 100 includes a blower 173, a blower 261, a blower 262, and a blower 263.

In the sheet manufacturing apparatus 100, a raw material supply process, a crushing process, a defibrating process, a sorting process, a first web forming process, a dividing process, a mixing process, a dispersing process, a second web forming process, a sheet molding process, and a cutting process are performed in this order.

Hereinafter, the configuration of each section will be described.

As illustrated in FIG. 1, the raw material supply section 11 is a portion that performs the raw material supply process of supplying a raw material M1 to the crushing section 12. As the raw material M1, a sheet-like material made of a fiber-containing material containing a cellulose fiber. The cellulose fiber may be any fibrous material containing cellulose as a main compound, and may contain hemicellulose and lignin in addition to cellulose. The form of the raw material M1 is not limited, such as woven fabric or non-woven fabric. The raw material M1 may be, for example, recycled paper recycled and manufactured by defibrating used paper, or synthetic YUPO paper (registered trademark), and may not be recycled paper. In the present embodiment, the raw material M1 is used or unnecessary used paper.

The crushing section 12 is a portion that performs the crushing process of crushing the raw material M1 supplied from the raw material supply section 11 in the air such as the atmosphere. The crushing section 12 has a pair of crushing blades 121 and a chute 122.

The pair of crushing blades 121 rotate in the opposite direction to each other, such that the raw material M1 can be crushed, that is, cut between the pair of crushing blades 121 to obtain coarse debris M2. A shape and a size of the coarse debris M2 are preferably suitable for the defibrating process of the defibrating section 13. For example, a small piece having a side length of 100 mm or less is preferable, and a small piece having a side length of 10 mm or more and 70 mm or less is more preferable.

The chute 122 is disposed below the pair of crushing blades 121 and has, for example, a funnel shape. Therefore, the chute 122 can receive the coarse debris M2 crushed and fallen by the crushing blade 121.

The humidifying section 231 is disposed above the chute 122 so as to be adjacent to the pair of crushing blades 121. The humidifying section 231 humidifies the coarse debris M2 in the chute 122. The humidifying section 231 is configured of a vaporization type, particularly, warm air vaporization type humidifier which has a filter (not illustrated) containing moisture and supplies humidified air with increased humidity to the coarse debris M2 by passing air through the filter. By supplying the humidified air to the coarse debris M2, it is possible to suppress the coarse debris M2 from adhering to the chute 122 and the like due to static electricity.

The chute 122 is coupled to the defibrating section 13 via a pipe 241. The coarse debris M2 collected in the chute 122 passes through the pipe 241 and is transported to the defibrating section 13.

The defibrating section 13 is a portion that performs a defibrating process of defibrating the coarse debris M2 in the air, that is, in a dry method. By performing the defibrating process of the defibrating section 13, a defibrated material M3 can be generated from the coarse debris M2. Here, "defibrating" means unraveling the coarse debris M2 formed by binding a plurality of fibers into individual fibers. Then, the unraveled fibers become the defibrated material M3. The shape of the defibrated material M3 is linear or strip-shaped. Furthermore, the defibrated materials M3 may exist in a state in which they are intertwined into an aggregate, that is, in a state of forming a so-called "lump".

In the present embodiment, for example, the defibrating section 13 is configured of an impeller mill having a rotor that rotates at a high speed and a liner that is located on the outer periphery of the rotor. The coarse debris M2 flowed into the defibrating section 13 is defibrated while being interposed between the rotor and the liner.

The defibrating section 13 can generate a flow of air from the crushing section 12 toward the sorting section 14, that is, an airflow, by the rotation of the rotor. Accordingly, the coarse debris M2 can be sucked into the defibrating section 13 from the pipe 241. After the defibrating process, the defibrated material M3 can be sent out to the sorting section 14 via a pipe 242.

The blower 261 is installed in the middle of the pipe 242. The blower 261 is an airflow generator that generates an airflow toward the sorting section 14. Accordingly, the sending out of the defibrated material M3 to the sorting section 14 is promoted.

The sorting section 14 is a portion that performs a sorting process of sorting the defibrated material M3 according to the length of the fibers. In the sorting section 14, the defibrated material M3 is sorted into a first sorted material M4-1 and a second sorted material M4-2 larger than the first sorted material M4-1. The first sorted material M4-1 has a size suitable for the subsequent manufacture of the sheet S. The average length of the first sorted material M4-1 is preferably 1 μm or more and 30 μm or less. On the other hand, the second sorted material M4-2 includes, for example, those in which fibers are insufficiently defibrated or those in which the defibrated fibers are excessively aggregated.

The sorting section 14 has a drum section 141 and a housing section 142 that houses the drum section 141.

The drum section 141 is a sieve that is formed of a cylindrical net body and rotates about its central axis. The defibrated material M3 flows into the drum section 141. As the drum section 141 rotates, the defibrated material M3 smaller than a mesh opening of the net is sorted as the first sorted material M4-1, and the defibrated material M3 larger than the mesh opening of the net is sorted as the second sorted material M4-2.

The first sorted material M4-1 falls from the drum section 141.

On the other hand, the second sorted material M4-2 is sent out to a pipe 243 coupled to the drum section 141. The pipe 243 is coupled to the pipe 241 on the opposite side of the drum section 141, that is, on the upstream. The second sorted material M4-2 passed through the pipe 243 merges with the coarse debris M2 in the pipe 241 and flows into the defibrating section 13 with the coarse debris M2. As a result, the second sorted material M4-2 is returned to the defibrating section 13 and is subjected to the defibrating process with the coarse debris M2.

The first sorted material M4-1 falls from the drum section 141 while being dispersed in the air and directs towards the first web forming section 15 located below the drum section 141. The first web forming section 15 is a portion that performs a first web forming process of forming a first web M5 from the first sorted material M4-1. The first web forming section 15 has a mesh belt 151, three stretching rollers 152, and a suction section 153.

The mesh belt 151 is an endless belt, and the first sorted material M4-1 is accumulated thereon. The mesh belt 151 is wound around the three stretching rollers 152. Then, the first sorted material M4-1 on the mesh belt 151 is transported downstream by the rotation of the stretching roller 152.

The first sorted material M4-1 has a size larger than the mesh opening of the mesh belt 151. As a result, the first sorted material M4-1 is restricted from passing through the mesh belt 151, and can thus be accumulated on the mesh belt 151. Further, the first sorted material M4-1 is transported downstream along with the mesh belt 151 while being accumulated on the mesh belt 151, and it is thus formed as a layered first web M5.

For example, dust and dirt may be mixed in the first sorted material M4-1. Dust and dirt may be generated due to crushing or defibration, for example. Such dust and dirt are collected in the collection section 27 to be described later.

The suction section 153 is a suction mechanism that sucks air from below the mesh belt 151. Accordingly, dust and dirt that has passed through the mesh belt 151 can be sucked together with air.

The suction section 153 is coupled to the collection section 27 via a pipe 244. The dust and dirt sucked by the suction section 153 are collected by the collection section 27.

A pipe 245 is further coupled to the collection section 27. Furthermore, the blower 262 is installed in the middle of the pipe 245. By the operation of the blower 262, a suction force can be generated in the suction section 153. As a result, the formation of the first web M5 on the mesh belt 151 is promoted. The first web M5 is one from which dust and dirt are removed. Furthermore, dust and dirt pass through the pipe 244 and reach the collection section 27 by the operation of the blower 262.

The housing section 142 is coupled to the humidifying section 232. The humidifying section 232 is configured of a vaporization type humidifier similar to the humidifying section 231. As a result, humidified air is supplied into the housing section 142. The first sorted material M4-1 can be humidified by the humidified air, thereby suppressing the first sorted material M4-1 from adhering on an inner wall of the housing section 142 by an electrostatic force.

The humidifying section 235 is disposed at the downstream of the sorting section 14. The humidifying section 235 is configured of an ultrasonic humidifier that sprays water. Accordingly, moisture can be supplied to the first web M5, thereby adjusting the moisture content of the first web M5. With this adjustment, it is possible to suppress adsorption of the first web M5 to the mesh belt 151 by the electrostatic force. As a result, the first web M5 is easily peeled off from the mesh belt 151 at a position where the mesh belt 151 is folded back by the stretching roller 152.

The subdividing section 16 is disposed at the downstream of the humidifying section 235. The subdividing section 16 is a portion that performs a dividing process of dividing the first web M5 peeled off from the mesh belt 151. The subdividing section 16 has a propeller 161 that is rotatably supported and a housing section 162 that houses the propeller 161. The first web M5 can be divided by the rotating propeller 161. The divided first web M5 becomes a subdivided body M6. Furthermore, the subdivided body M6 descends in the housing section 162.

The housing section 162 is coupled to the humidifying section 233. The humidifying section 233 is configured of a vaporization type humidifier similar to the humidifying section 231. As a result, humidified air is supplied into the housing section 162. With the humidified air, it is possible to suppress the subdivided body M6 from adhering to the propeller 161 or an inner wall of the housing section 162 by the electrostatic force.

The mixing section 17 is disposed at the downstream of the subdividing section 16. The mixing section 17 is a portion that performs a mixing process of mixing a subdivided body M6 and a resin P1. The mixing section 17 has a resin supply section 171, a pipe 172, and a blower 173.

The pipe 172 couples the housing section 162 of the subdividing section 16 and the accumulating section 18, and is a path through which a mixture M7 of the subdivided body M6 and the resin P1 passes.

The resin supply section 171 is coupled in the middle of the pipe 172. The resin supply section 171 has a screw feeder 174. The screw feeder 174 rotates, such that the resin P1 can be supplied into the pipe 172 as powders or particles. The resin P1 supplied into the pipe 172 is mixed with the subdivided body M6 to obtain the mixture M7.

The resin P1 allows fibers to bind to each other in a subsequent process, and examples thereof can include a thermoplastic resin, a curable resin, and the like, but a thermoplastic resin is preferably used. Examples of thermoplastic resin include AS resin; ABS resin; polyolefin such as polyethylene, polypropylene, and ethylene-vinyl acetate copolymer (EVA); modified polyolefin; acrylic resin such as polymethyl methacrylate; polyester such as polyvinyl chloride, polystyrene, polyethylene terephthalate, and polybutylene terephthalate; polyamide such as nylon 6, nylon 46, nylon 66, nylon 610, nylon 612, nylon 11, nylon 12, nylon 6-12, and nylon 6-66; polyphenylene ether; polyacetal; polyether; polyphenylene oxide; polyether ether ketone; polycarbonate; polyphenylene sulfide; thermoplastic polyimide; polyether imide; liquid crystal polymer such as aromatic polyester; and various thermoplastic elastomers such as styrene-based elastomer, polyolefin-based elastomer, polyvinyl chloride-based elastomer, polyurethane-based elastomer, polyester-based elastomer, polyamide-based elastomer, polybutadiene-based elastomer, trans-polyisoprene-based elastomer, fluororubber-based elastomer, and chlorinated polyethylene-based elastomer. One or more of these materials selected therefrom may be used independently or in combination. As the thermoplastic resin, polyester or a resin containing these materials is preferably used.

In addition to the resin P1, examples of materials supplied from the resin supply section 171 may include a colorant for coloring fiber, an aggregation inhibitor for suppressing aggregation of fiber or resin P1, a flame retardant for making the fiber difficult to burn, and a paper strengthening agent for strengthening a paper strength of the sheet S. Alternatively, a material obtained by containing the materials in the resin P1 in advance and compositing them may be supplied from the resin supply section 171.

In the middle of the pipe 172, the blower 173 is installed downstream of the resin supply section 171. The subdivided body M6 and the resin P1 are mixed by an action of a rotation section such as a blade of the blower 173. Furthermore, the blower 173 can generate airflow toward the accumulating section 18. With this airflow, the subdivided body M6 and the resin P1 can be stirred in the pipe 172. As a result, the mixture M7 can flow into the accumulating section 18 in a state in which the subdivided body M6 and the resin P1 are uniformly dispersed. Furthermore, the subdivided body M6 in the mixture M7 is loosened during passing through the pipe 172 and becomes a finer fibrous.

The accumulating section 18 performs a dispersing process of loosening a material containing fiber, that is, the intertwined fibers in the mixture M7 and dispersing the fibers in the air. A configuration of the accumulating section 18 will be described in detail later. The mixture M7 dispersed in the air by the accumulating section 18 falls toward the second web forming section 19 located below the accumulating section 18.

The second web forming section 19 is a portion that performs a second web forming process of forming a second web M8 from the mixture M7. The second web forming section 19 has a mesh belt 191, stretching rollers 192, and a suction section 193.

The mesh belt 191 is an endless belt, and the mixture M7 is accumulated thereon. The mesh belt 191 is wound around four stretching rollers 192. Then, the mixture M7 on the mesh belt 191 is transported downstream by the rotation of the stretching roller 192.

Most of the mixture M7 on the mesh belt 191 has a size larger than the mesh opening of the mesh belt 191. As a result, the mixture M7 can be restricted from passing through the mesh belt 191, thereby being accumulated on the mesh belt 191. Furthermore, the mixture M7 is transported downstream along with the mesh belt 191 while being accumulated on the mesh belt 191, and it is thus formed as a layered second web M8.

The suction section 193 is a suction mechanism that sucks air from below the mesh belt 191. Accordingly, the mixture M7 can be sucked onto the mesh belt 191, thereby promoting the mixture M7 being accumulated on the mesh belt 191.

A pipe 246 is coupled to the suction section 193. Furthermore, the blower 263 is installed in the middle of the pipe 246. By the operation of the blower 263, a suction force can be generated in the suction section 193.

The humidifying section 236 is disposed at the downstream of the accumulating section 18. The humidifying section 236 is configured of an ultrasonic humidifier similar to the humidifying section 235. As a result, moisture can be supplied to the second web M8, thereby adjusting the moisture content of the second web M8. With this adjustment, it is possible to suppress adsorption of the second web M8 to the mesh belt 191 by the electrostatic force. As a result, the second web M8 is easily peeled off from the mesh belt 191 at a position where the mesh belt 191 is folded back by the stretching roller 192.

The total content of the moisture added to the humidifying sections 231 to 236 is preferably 0.5 parts by mass or more and 20 parts by mass or less with respect to 100 parts by mass of the material before humidification, for example.

The sheet molding section 20 is disposed at the downstream of the second web forming section 19. The sheet molding section 20 is a portion that performs a sheet molding process of molding the sheet S from the second web M8. The sheet molding section 20 has a pressurizing section 201 and a heating section 202.

The pressurizing section 201 has a pair of calender rollers 203 and can pressurize the second web M8 between the calender rollers 203 without heating. Accordingly, the density of the second web M8 is increased. In this case, the second web M8 is heated to some extent that the resin P1 is not melted, which is preferable. Then, the second web M8 is transported toward the heating section 202. One of the pair of calender rollers 203 is a driving roller driven by the operation of a motor (not illustrated), and the other is a driven roller.

The heating section 202 has a pair of heating rollers 204 and can pressurize the second web M8 between the heating rollers 204 while heating the second web M8. By heating and pressurizing the second web M8, the resin P1 is melted in the second web M8, and fibers are bound to each other through the melted resin P1. As a result, the sheet S is formed. Then, the sheet S is transported toward the cutting section 21. One of the pair of heating rollers 204 is a driving roller driven by the operation of a motor (not illustrated), and the other is a driven roller.

The cutting section 21 is disposed at the downstream of the sheet molding section 20. The cutting section 21 is a portion that performs a cutting process of cutting the sheet S. The cutting section 21 has a first cutter 211 and a second cutter 212.

The first cutter 211 cuts the sheet S in a direction intersecting a transport direction of the sheet S, particularly, a direction orthogonal to the transport direction of the sheet S.

The second cutter 212 cuts the sheet S in a direction parallel to the transport direction of the sheet S at the downstream of the first cutter 211. This cutting is to remove unnecessary portions at both end portions of the sheet S, that is, end portions in +y axis direction and −y axis direction and to adjust the width of the sheet S. The cut and removed portion is called "edge".

By the cutting performed with the first cutter 211 and the second cutter 212, a sheet S having a desired shape and size can be obtained. The sheet S is further transported downstream and accumulated in the stock section 22.

Next, the accumulating section 18 will be described.

As illustrated in FIGS. 2 to 4, the accumulating section 18 includes a housing 3, a drum 4 that is located in the housing 3 for dispersing the accommodated mixture M7, and a supply section 5 that supplies the mixture M7 to the drum 4, and a rotating body 6 that is provided in the drum 4.

The housing 3 has a tubular housing body 31. The housing body 31 has four side walls 311. The housing body 31 houses the drum 4 in a space S1 surrounded by the side walls 311 and covers a portion between the drum 4 and the mesh belt 191.

Further, the housing body 31 has a lower opening 312 facing the mesh belt 191 and an upper opening 313 located on a side opposite to the lower opening 312. The lower opening 312 is an outlet for releasing the mixture M7 dispersed from the drum 4. In addition, the upper opening 313 is covered with a top plate 41 of the drum 4.

The accumulating section 18 includes the housing 3 that covers the space S1 which is a portion between the drum 4 and the mesh belt 191 and has the lower opening 312 formed at a position facing the mesh belt 191. As a result, the suction force of the suction section 193 can effectively form an airflow toward the lower side in the space S1. Therefore, it is possible to promote the accumulation of the mixture M7 dispersed from the drum 4 on the mesh belt 191.

As illustrated in FIG. 1, the housing 3 is coupled to the humidifying section 234. The humidifying section 234 is configured of a vaporization type humidifier similar to the humidifying section 231. As a result, humidified air is supplied into the housing 3. The humidified air can humidify the inside of the housing 3, and therefore, it is possible to suppress the dispersed mixture M7 from adhering to an inner wall of the housing 3 by the electrostatic force.

The drum 4 has a top plate 41 closing an upper opening 313 of the housing 3, a pair of side walls 42 installed on a lower side of the top plate 41, and a porous screen 43.

The top plate 41 has a supply port 411 provided to penetrate the top plate 41 in the thickness direction thereof. The supply port 411 communicates with the supply section 5 and is a portion through which the mixture M7 passes. In addition, the supply port 411 has an elongated shape extending in the y axis direction, and is provided at a substantially central portion of the top plate 41 in the x axis direction. The pair of side walls 42 have an elongated shape extending in the y axis direction, and are arranged on a lower surface of the top plate 41 and facing each other via the supply port 411.

The porous screen 43 has a semi-cylindrical shape extending in the y axis direction and protruding in the −z axis direction. That is, the porous screen 43 has an arcuate portion at any position in the y axis direction when viewed from a cross section with the y axis as a normal line. As a result, the mixture M7 can move smoothly in the drum 4 and can be stirred well. In addition, the porous screen 43 is connected to each side wall 42, and a space defined by the porous screen 43, the side walls 42, and the top plate 41 functions as an accommodation space S2 for accommodating the mixture M7.

In the drum 4, a +y axis side and a −y axis side of the accommodation space S2 are closed by wall portions (not illustrated). Each wall portion rotatably supports the rotating body 6 to be described later.

The porous screen 43 can be, for example, a net-like body or a plate material having a large number of through-holes. As a result, the mixture M7 in the drum 4 is released to the outside of the accommodation space S2 via the porous screen 43 and dispersed. Further, by appropriately setting the mesh opening size or the size of the through-holes of the porous screen 43, the mixture M7 having a desired fiber length can be preferentially dispersed and accumulated on the mesh belt 191.

As illustrated in FIG. 2, the supply section 5 is a port installed on an upper side of the top plate 41. The supply section 5 has a port body 51 and a coupling section 52 provided on the port body 51.

The port body 51 has a box shape having a quadrangular opening 511 on a lower side. The opening 511 has a long quadrangular shape having a size sufficient to include the supply port 411 of the top plate 41. The port body 51 is installed on an upper part of the top plate 41 so as to communicate with the supply port 411 of the top plate 41 through the opening 511. As a result, the mixture M7 can be supplied into the drum 4 via the supply section 5.

As illustrated in FIG. 2, the port body 51 has a substantially triangular shape when viewed from the x axis direction. Therefore, when viewed from a cross section with the z axis as a normal line, the port body 51 becomes wider toward the lower side.

Further, a coupling section 52 is provided on an upper part of the side wall 512 on the −x axis side of the port body 51. The coupling section 52 is a portion formed in a cylindrical shape so as to protrude in the −x axis direction, and is coupled to the pipe 172 through which the mixture M7 flows down.

First, the mixture M7 that has flowed down the pipe 172 flows into the port body 51 via the coupling section 52. Then, when the mixture M7 flows into the port body 51, the mixture M7 collides with the side wall 513 facing the side wall 512 or is transported to the vicinity thereof by an airflow. At this time, the mixture M7 is loosened to some extent and directed downward. As a result, even if lumps are generated in the mixture M7, it is possible to prevent the mixture M7 from being supplied into the drum 4 as it is. Then, the mixture M7 is supplied into the drum 4 through the opening 511 and the supply port 411.

As illustrated in FIG. 3, when the mixture M7 flows into the drum 4, the mixture M7 flows into the drum 4 on the +x axis side from the central axis O because it flows down along the side wall 513 as described above. As will be described later, since the rotating body 6 rotates counterclockwise when viewed from the +y axis side, the mixture M7 flowing into the drum 4 is moved with the airflow along a rotation direction of the rotating body 6 as it is. That is, the supply section 5 supplies the mixture M7, which is a material, along the rotation direction of the rotating body 6. As a result, it is possible to smoothly loosen the mixture M7 in the drum 4 while reducing the mixture M7 staying in the drum 4 or the mixture M7 wound up to the supply section 5 side.

As illustrated in FIGS. 1 to 4, the rotating body 6 rotates in the drum 4, and thus has a function to promote dispersion of the mixture M7 from the porous screen 43 while stirring and loosening the mixture M7 supplied into the drum 4. The rotating body 6 has four blades 61 and a shaft 62 that fixes and supports each blade 61. Further, a central axis of the shaft 62 is the central axis O of the rotating body 6. The central axis O is also a rotation axis of the rotating body 6.

When such a rotating body 6 rotates, the blades 61 come into contact with the mixture M7 in the drum 4 to stir the mixture M7, and an appropriate amount of the mixture M7 is pressed against the porous screen 43 while loosening the fibers. As a result, the mixture M7 can be prevented from being clogged by the porous screen 43, and the mixture M7 can be evenly dispersed from the entire porous screen 43.

As illustrated in FIG. 4, the rotating body 6 is coupled to a motor 60, and a rotational force of the motor 60 is transmitted to rotate the rotating body 6. In addition, the motor 60 is electrically coupled to the drive control section 281 of the control section 28 via a motor driver (not illustrated), and a rotation speed is adjusted by the drive control section 281 changing an energization condition.

Next, a detection section 7 will be described. As illustrated in FIGS. 2 to 4, the detection section 7 has an emission section 71 that emits an energy ray E and an incidence section 72 on which the energy ray E emitted by the emission section 71 is incident, and detects the presence of the mixture M7.

As illustrated in FIG. 5, the emission section 71 and the incidence section 72 are electrically coupled to the control section 28, and an operation of the emission section 71 is controlled by the drive control section 281. In addition, the incidence section 72 transmits, to an estimation section 282, information that the energy ray E is incident.

When the mixture M7 passes between the emission section 71 and the incidence section 72, the energy ray E emitted by the emission section 71 is blocked by the mixture M7 to be in a blocked state, and the incidence section 72 does not detect the energy ray E temporarily. Information that the energy ray E is in a blocked state is transmitted from the incidence section 72 to the estimation section 282 to be described later, and the estimation section 282 estimates a frequency of the energy ray E to be shielded, that is, an amount of the mixture M7 based on a detection frequency. This will be described in detail later.

The energy ray E is not particularly limited, and examples thereof include light such as ultrasonic waves, visible light, and infrared light. Among these, the energy ray E is preferably an ultrasonic wave. That is, the detection section 7 is preferably an ultrasonic sensor. When the detection section 7 is an ultrasonic sensor, it can adjust and shorten a sampling cycle. Therefore, accuracy of the detection frequency can be enhanced.

As illustrated in FIGS. 2 and 4, the emission section 71 and the incidence section 72 are installed on an inner surface of the housing body 31. Specifically, the emission section 71 is installed on an inner surface of the side wall 311 on the +Y axis side, and the incidence section 72 is installed on the inner surface of the side wall 311 on the −Y axis side. In other words, the emission section 71 and the incidence section 72 are arranged so as to face each other along the Y axis. The emission section 71 and the incidence section 72 may be installed on an outer surface of the housing body 31. In this case, through-holes are formed in the housing body 31, and the emission section 71 and the incidence section 72 are installed in the direction in which the energy ray E passes through the through-holes.

The emission section 71 may be installed on an inner surface of the side wall 311 on the −Y axis side, and the incidence section 72 may be installed on the inner surface of the side wall 311 on the +Y axis side.

The emission section 71 emits the energy ray E toward the incidence section 72, that is, from the +Y axis side to the −Y axis side. Therefore, the energy ray E in the drum 4 travels in a direction along the central axis O of the drum 4. As a result, a behavior that the mixture M7 moving along a direction of rotating around the central axis O shields or allows the energy ray E to be incident on the incidence section 72 is more remarkable. Therefore, as will be described later, the detection frequency can be accurately grasped.

Further, the emission section 71 and the incidence section 72 are located above the central axis O in the drum 4. That is, in the drum 4, the energy ray E passes vertically above the central axis O of the drum 4, that is, on the +Z axis side of the central axis O. The mixture M7 tends to stay below the central axis O in the drum 4, and the shielding state tends to continue for a relatively long time. On the other hand, with the above configuration, the mixture M7 moving along the direction of rotating around the central axis O can be temporarily shielded. Therefore, as will be described later, the detection frequency can be accurately grasped. "Vertically above the central axis O in the drum 4" is referred to as a position higher than a position where the central axis O is located, and is not limited to a position directly above the central axis O.

Next, the control section 28 will be described.

As illustrated in FIG. 5, the control section 28 includes the drive control section 281, the estimation section 282, and the storage section 283.

The drive control section 281 controls drive of each section of the sheet manufacturing apparatus 100. In addition, as described above, the drive control section 281 controls the rotating body 6 and adjusts the rotation speed of the rotating body 6. As a result, the release amount of the mixture M7 from the accumulating section 18 can be adjusted.

The drive control section 281 is composed of at least one processor. Examples of the processor include a central processing unit (CPU) and the like.

The estimation section 282 estimates the amount of the mixture M7 in the drum 4 based on a detection frequency at which the detection section 7 detects the mixture M7, that is, the shield frequency described above. The detection frequency is the above-described shield frequency, and refers to the number of times that the energy ray E is blocked from being incident on the incidence section 72 per unit time, or a ratio of time when the energy ray E is blocked from being incident on the incidence section 72 per unit time.

The estimation section 282 calculates such a detection frequency and estimates the amount of the mixture M7 in the drum 4 with reference to a calibration curve K. As illustrated in FIG. 6, the calibration curve K is represented by, for example, a shield frequency on a horizontal axis and a retention amount, that is, the amount of the mixture M7 in the drum 4, on a vertical axis. The calibration curve K is data obtained by measuring the amount of the mixture M7 in the drum 4 experimentally in advance for each detection frequency and plotting values thereof. The calibration curve K is stored in the storage section 283.

The calibration curve K is a calibration curve in consideration of a frequency at which the rotating body 6 is shielded when rotated at a predetermined rotation speed, that is, a frequency at which the blades 61 pass between the emission section 71 and the incidence section 72.

The estimation section 282 is composed of at least one processor. Examples of the processor include a central processing unit (CPU) and the like.

For example, the storage section 283 stores, for example, various programs such as a program for manufacturing a sheet S, the calibration curve K, other calibration curves or tables, various thresholds, and the like.

The control section 28 may be incorporated in the sheet manufacturing apparatus 100, or may be provided in an external device such as an external computer. For example, the external device may communicate with the sheet manufacturing apparatus 100 via a cable or the like or in a wireless manner, for example, the external device may be coupled to the sheet manufacturing apparatus 100 via the network such as the Internet.

Further, for example, the drive control section 281 and the estimation section 282, and the storage section 283 may be integrated into a single unit. The drive control section 281 and the estimation section 282 may be incorporated in the sheet manufacturing apparatus 100, and the storage section 283 may be provided in an external device such as an external computer. The storage section 283 may be incorporated in the sheet manufacturing apparatus 100, and the drive control section 281 and the estimation section 282 may be provided in an external device such as an external computer.

As described above, the fibrous body accumulating device 10 includes the storage section 283 in which the calibration curve K indicating a relationship between the detection frequency and the amount of the mixture M7 which is the material in the drum 4 is stored. Then, the estimation section 282 calculates information on the detection frequency and estimates the amount of the mixture M7 in the drum 4 with reference to the calibration curve K. As a result, the mixture M7 in the drum 4 can be grasped under simple control. Thus, as will be described later, the release amount of the mixture M7 from the accumulating section 18 can be adjusted by feeding back to the control of the operation of the accumulating section 18. Therefore, the second web M8 can have a desired thickness distribution, and the quality of the sheet S can be improved.

Further, the detection section 7 has the emission section 71 that emits the energy ray E and the incidence section 72 on which the energy ray E emitted by the emission section 71 is incident, and the estimation section 282 calculates the detection frequency based on a frequency at which the energy ray E is incident on the incidence section 72. As a result, an accurate detection frequency can be calculated.

As described above, the fibrous body accumulating device includes the accumulating section 18 that includes the drum 4 that introduces and releases the mixture M7, which is a material containing fibers, the detection section 7 that detects the presence of the mixture M7 in the drum 4, and the estimation section 282 that estimates the amount of the mixture M7 in the drum 4 based on the detection frequency at which the detection section 7 detects the mixture M7. As a result, the amount of the mixture M7 in the drum 4 can be grasped. Thus, as will be described later, the release amount of the mixture M7 from the accumulating section 18 can be adjusted by feeding back to the control of the operation of the accumulating section 18. Therefore, the second web M8 can have a desired thickness distribution, and the quality of the sheet S can be improved.

In particular, since the configuration is made such that the amount of the mixture M7 is estimated based on the detection frequency, the apparatus can be simply configured and can quickly grasp the amount of the mixture M7, as compared with the configuration in which the weight of the mixture M7 in the drum 4 is measured.

Next, a control operation performed by the control section 28, that is, an example of the estimation method of the present disclosure will be described based on a flowchart illustrated in FIG. 7.

First, in step S101, sheet manufacturing is started, and measurement, that is, detection of a retention amount in the drum 4 is started. That is, the detection frequency at which the detection section 7 detects the mixture M7 is obtained. Next, in step S102, the rotating body 6 is operated under a predetermined condition. That is, the rotating body 6 is rotated at a predetermined rotation speed. As a result, the mixture M7 in the drum 4 is satisfactorily loosened and released from the drum 4 to generate a second web M8.

Next, in step S103, it is determined whether or not the retention amount of the mixture M7 in the drum 4 exceeds a specified amount. As described above, the determination is made by estimating the retention amount based on the calibration curve K indicating the relationship between the detection frequency at which the detection section 7 detects the mixture M7 and the amount of the mixture M7 in the drum 4, and comparing the estimation result and the specified amount which is the threshold set in advance.

When it is determined in step S103 that the retention amount exceeds the specified amount, an operation of the motor 60 is controlled so as to increase the rotation speed of the rotating body 6 in step S104. When the retention amount exceeds the specified amount, it is considered that lumps are generated in the mixture M7 and the release amount of the mixture M7 is less than a desired amount, and the rotation speed of the rotating body 6 is increased to stir the mixture M7 and promote loosening of fibers. As a result, it is possible to adjust the release amount of the mixture M7 to be increased. Therefore, the release amount of the mixture M7 can be stabilized in the vicinity of the desired amount.

In step S104, the rotation speed may be adjusted to a preset rotation speed, and the rotation speed may be changed according to a level of the retention amount. In this case, a calibration curve or table showing the relationship between the retention amount and the rotation speed is stored in the storage section 283, and the rotation speed can be thus obtained by referring to the calibration curve or the table. The process is the same for step S106.

When it is determined in step S103 that the retention amount does not exceed the specified amount, the process proceeds to step S102.

Next, in step S105, it is determined again whether or not the retention amount of the mixture M7 in the drum 4 exceeds the specified amount. When it is determined in step S105 that the retention amount does not exceed the specified amount, an operation of the motor 60 is controlled so as to decrease the rotation speed of the rotating body 6 in step S106. When the retention amount is less than the specified amount, it is regarded that the retention amount of the mixture M7 in the drum 4 is appropriate, and the rotation speed is adjusted to return to the rotation speed of the rotating body 6 in step S102. As a result, the release amount of the mixture M7 can be stabilized in the vicinity of the desired amount.

Next, in step S107, it is determined whether or not paper manufacturing is terminated, that is, whether or not sheet manufacturing is terminated. The determination is made based on whether or not the number of manufactured sheets S has reached the predetermined number.

When it is determined that paper manufacturing is completed in step S107, in step S108, the rotating body 6 is stopped after the specified time has elapsed and the operation of each section of the sheet manufacturing apparatus 100 is stopped. When it is determined that paper manufacturing is not completed in step S107, the process returns to step S102, and subsequent steps are repeated sequentially.

As described above, the estimation method of the present disclosure is an estimation method for estimating the amount of the mixture M7 in the drum 4 of the accumulating section 18 including the drum 4 that introduces and releases the material containing fibers. In addition, in the estimation method of the present disclosure, the presence of the mixture M7 in the drum 4 is detected to estimate the amount of the mixture M7 in the drum 4 based on the detection frequency. As a result, the amount of the mixture M7 in the drum 4 can be grasped. Thus, for example, the release amount of the mixture M7 from the accumulating section 18 can be adjusted by feeding back to the control of the operation of the accumulating section 18. As a result, the second web M8 can have a desired thickness distribution, and the quality of the sheet S can be improved.

In particular, since the configuration is made such that the amount of the mixture M7 is estimated based on the detection frequency, the apparatus can be simply configured and can quickly grasp the amount of the mixture M7, as compared with the configuration in which the weight of the mixture M7 in the drum 4 is measured.

The fibrous body accumulating device 10 includes a drive control section 281 that controls the operation of the accumulating section 18 to adjust the release amount of the mixture M7 according to the estimation result of the estimation section 282. As a result, the second web M8 can have a desired thickness distribution, and the quality of the sheet S can be improved.

The accumulating section 18 has the rotating body 6 that is installed in the drum 4 and rotated to stir the mixture M7 which is a material in the drum 4. Then, the drive control section 281 adjusts the rotation speed of the rotating body 6 according to the estimation result of the estimation section 282. As a result, the release amount of the mixture M7 from can be adjusted in a simple manner. Therefore, the second web M8 can have a desired thickness distribution in a simple manner, and the quality of the sheet S can be improved.

Second Embodiment

Figure 8:
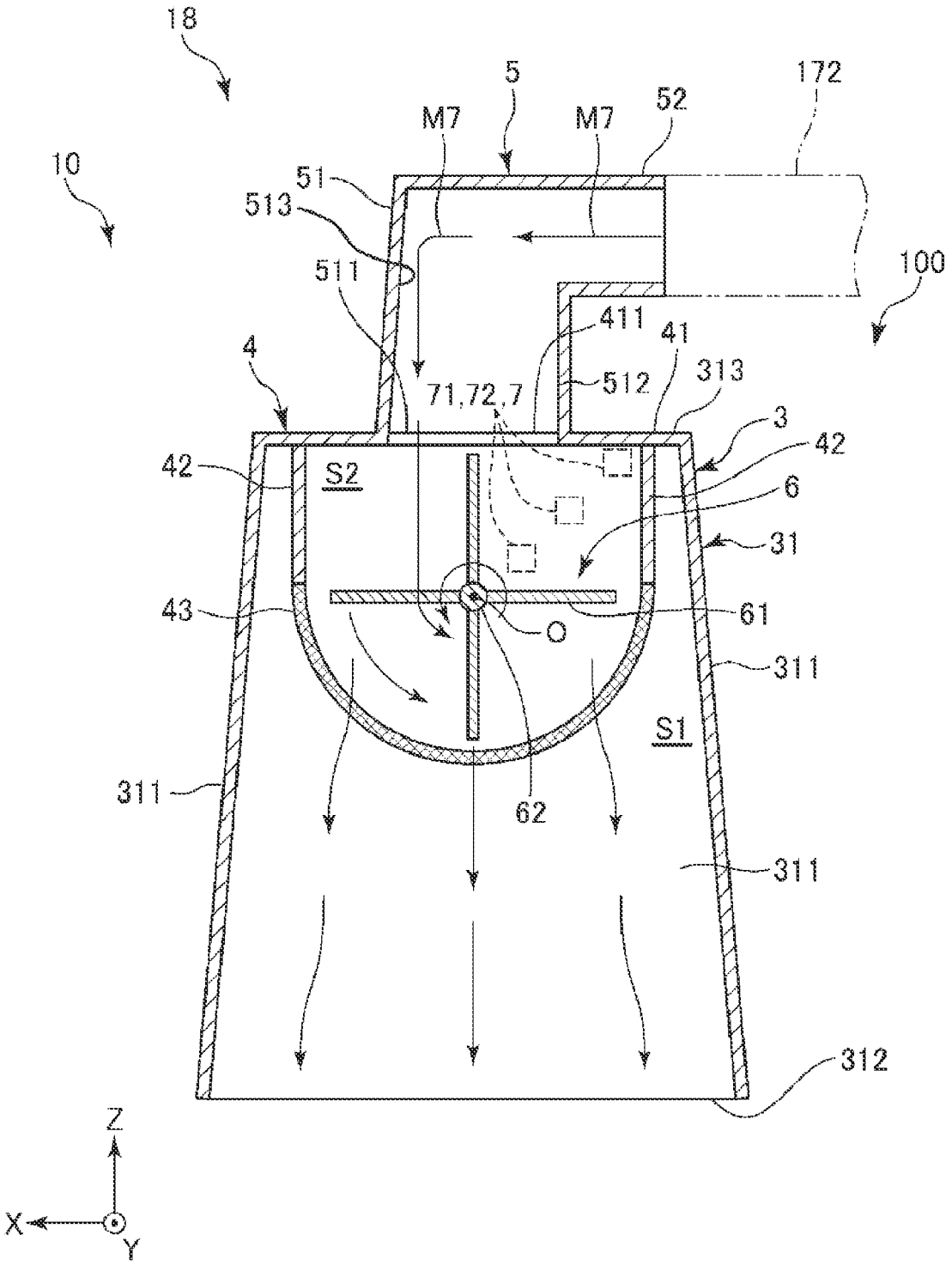
FIG. 8 is a cross-sectional view of an accumulating section of a second embodiment of a fibrous body accumulating device according to the present disclosure.
Figure 9:
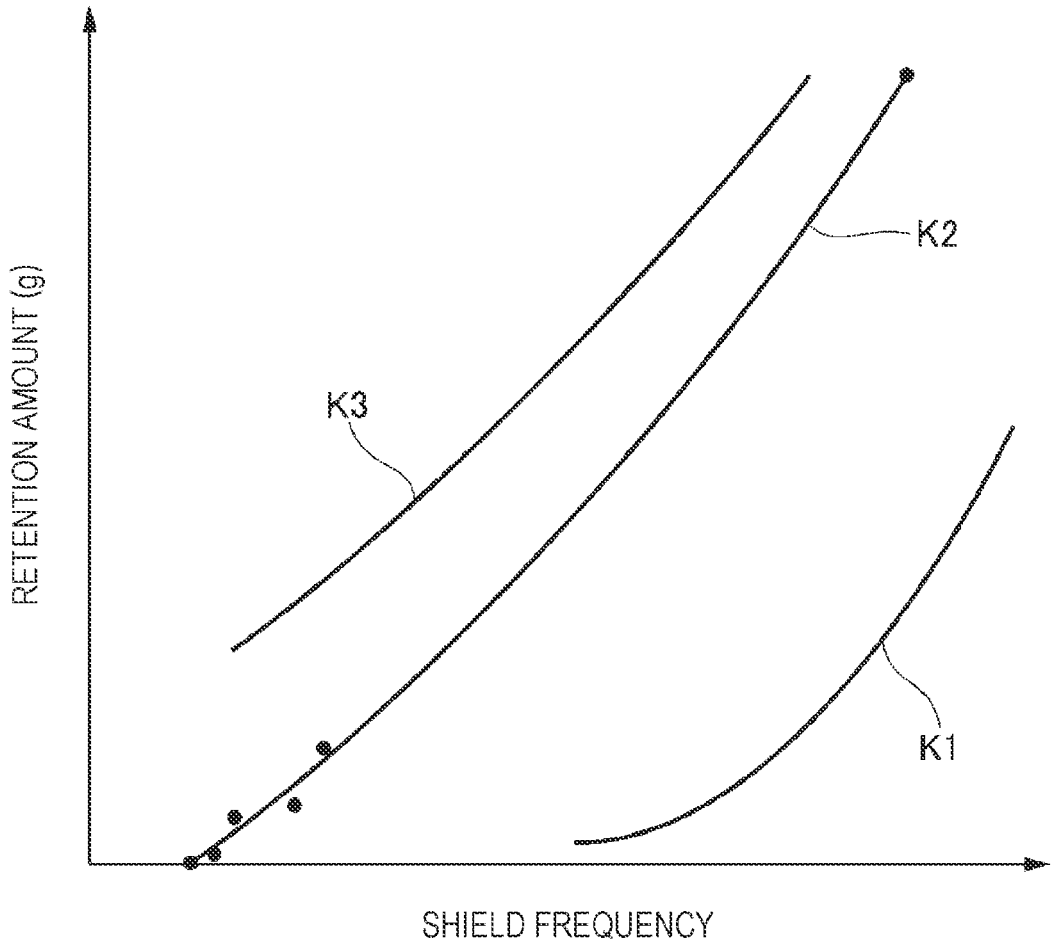
FIG. 9 is a graph illustrating a plurality of calibration curves stored in a storage section of the fibrous body accumulating device according to the second embodiment in one graph.

FIG. 8 is a cross-sectional view of an accumulating section of a second embodiment of a fibrous body accumulating device according to the present disclosure. FIG. 9 is a graph illustrating a plurality of calibration curves stored in a storage section of the fibrous body accumulating device according to the second embodiment in one graph.

Hereinafter, the second embodiment of the fibrous body accumulating device and the estimation method of the present disclosure will be described with reference to FIGS. 8 and 9. Differences from the above-described embodiment will be mainly described, and description of similar matters will be omitted.

As illustrated in FIG. 8, in the present embodiment, the detection section 7 has three pairs of the emission section 71 and the incidence section 72. The first pair is located near the central axis O when viewed from the Y axis direction. The second pair is located on the outer peripheral side of the drum 4 from the first pair when viewed from the Y axis direction. The third pair is located on the most outer peripheral side of the drum 4 when viewed from the Y axis direction. That is, the first pair, the second pair, and the third pair are arranged side by side from the central axis O toward the outer peripheral side in this order.

The three pairs of the emission section 71 and the incidence section 72 are located vertically above the central axis O. In addition, the first pair and the second pair of the emission section 71 and the incidence section 72 are arranged at positions where the rotating body 6 passes between the emission section 71 and the incidence section 72 when the rotating body 6 rotates. On the other hand, the third pair of the emission section 71 and the incidence section 72 are arranged at positions where the rotating body 6 does not pass between the emission section 71 and the incidence section 72 when the rotating body 6 rotates.

According to such a configuration, for example, in a mode in which the large amount of the mixture M7 is in the drum 4, the detection frequency is obtained by using the first pair, that is, the emission section 71 and the incidence section 72 closest to the central axis O. In addition, in a mode in which the amount of the mixture M7 in the drum 4 is a standard amount, the detection frequency is obtained by using the second pair, that is, the emission section 71 and the incidence section 72 located outside the first pair. In addition, in a mode in which the small amount of the mixture M7 is in the drum 4, the detection frequency is obtained by using the third pair, that is, the emission section 71 and the incidence section 72 located on the outermost side of the drum.

With such a configuration, the detection frequency can be obtained at an appropriate position according to the amount of the mixture M7 in the drum 4, that is, according to the mode. In addition, in the present embodiment, as illustrated in FIG. 9, a calibration curve K1, a calibration curve K2, and a calibration curve K3 are stored in the storage section 283. For the calibration curves K1 to K3, relationships between the detection frequency and the retention amount are different. That is, even when the detection frequency is the same, the retention amount differs depending on the detection position.

As such, the calibration curves K1 to K3 considering fluctuation of the retention amount due to the difference in the detection position are stored in the storage section 283, and when the retention amount is obtained from the detection frequency, the optimum calibration curve is referred to, such that the retention amount can be estimated accurately regardless of the mode.

As described above, in the present embodiment, a plurality of pairs of the emission section 71 and the incidence section 72 are arranged at different positions in the drum 4. As a result, as described above, the detection frequency can be obtained by using the emission section 71 and the incidence section 72 at the appropriate position according to the mode in which the retention amount of the mixture M7 in the drum 4 is different. Therefore, the retention amount can be estimated accurately regardless of the mode.

The calibration curve K1 and the calibration curve K2 are a calibration curve obtained by considering the frequency at which the rotating body 6 is shielded when rotating at a predetermined rotation speed, and the calibration curve K3 is a calibration curve obtained by not considering shielding of the rotating body 6.

As described above, the fibrous body accumulating device and the estimation method of the present disclosure are described with respect to the illustrated embodiments. However, the present disclosure is not limited to this, and each section and each step which constitute the fibrous body accumulating device and the estimation method can be replaced with any components and steps that can exhibit the same function. Furthermore, any components and steps may be added.

Moreover, the fibrous body accumulating device and the estimation method of the present disclosure may also combine the components and characteristics of any two or more of the above embodiments.

What is claimed is:

1. A fibrous body accumulating device comprising:

a drum having a porous screen, the drum introducing a material including fibers and releasing the material to outside of the drum via the porous screen;

a housing that houses the drum;

a detection section disposed on the housing and detecting a presence of the material in the drum;

at least one first processor constituting an estimation section that is electrically connected to the detection section and estimates an amount of the material in the drum based on a detection frequency at which the detection section detects the material; and a data storage in which data of a calibration curve showing a relationship between the detection frequency and the amount of the material in the drum are stored, wherein the estimation section calculates information on the detection frequency and estimates the amount of the material in the drum with reference to the calibration curve.

2. The fibrous body accumulating device according to claim 1, wherein the detection section includes an emission section and an incidence section, the emission section is disposed on the housing and emits an energy ray, and the incidence section is disposed on the housing such that the energy ray emitted by the emission section is incident on the incidence section, and the estimation section calculates the detection frequency based on a frequency at which the energy ray is incident on the incidence section.

3. The fibrous body accumulating device according to claim 2, wherein the energy ray in the drum travels in a direction along a central axis of the drum.

4. The fibrous body accumulating device according to claim 2, wherein in the drum, the energy ray passes vertically above a central axis of the drum.

5. The fibrous body accumulating device according to claim 2, wherein the energy ray is an ultrasonic wave.

6. The fibrous body accumulating device according to claim 2, wherein a plurality of pairs of the emission section and the incidence section are disposed on the housing, and arranged at different positions in the drum as viewed in a direction along a central axis of the drum.

7. The fibrous body accumulating device according to claim 1, further comprising:

at least one second processor constituting a drive control section that is electrically connected to the at least one first processor and adjusts a release amount of the material according to an estimation result of the estimation section.

8. The fibrous body accumulating device according to claim 7, further comprising:

a rotating body that is installed in the drum and rotates to stir the material in the drum, wherein the drive control section adjusts a rotation speed of the rotating body according to the estimation result of the estimation section.

9. An estimation method for estimating an amount of a material including fibers in a drum, the estimation method comprising:

detecting a presence of the material in the drum that has a porous screen, the drum introducing the material and releasing the material to outside of the drum via the porous screen; and estimating the amount of the material in the drum based on a detection frequency, wherein the estimating of the amount of the material in the drum includes calculating information on the detection frequency and estimating the amount of the material in the drum with reference to a calibration curve stored in a data storage, the calibration curve showing a relationship between the detection frequency and the amount of the material in the drum.

* * * * *